US007383846B2

(12) United States Patent
Curran

(10) Patent No.: US 7,383,846 B2
(45) Date of Patent: Jun. 10, 2008

(54) DISHWASHER BASKET

(75) Inventor: Jesse Allen Curran, Versailles, KY (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 10/611,297

(22) Filed: Jul. 1, 2003

(65) Prior Publication Data

US 2005/0000554 A1 Jan. 6, 2005

(51) Int. Cl.
*B08B 3/00* (2006.01)
*A47G 19/08* (2006.01)

(52) U.S. Cl. ..... 134/135; 134/137; 134/85; 134/201; 211/41.2; 211/41.3; 211/41.4; 211/41.5; 211/41.6

(58) Field of Classification Search ..... 134/135, 134/57 D, 85, 137, 201; 211/41.2–41.9
See application file for complete search history.

(56) References Cited

U.S. PATENT DOCUMENTS 2,343,657 A * 3/1944 Fox ..... 211/46
2,524,900 A * 10/1950 Einhorn ..... 220/6
2,529,267 A * 11/1950 Sloane ..... 220/6
4,732,291 A * 3/1988 McConnell ..... 220/488
4,834,125 A * 5/1989 Insalaco ..... 134/201
5,123,540 A 6/1992 Karavias
5,287,984 A 2/1994 Michael
5,431,294 A 7/1995 Stottmann et al.
5,497,890 A 3/1996 Clark

* cited by examiner

*Primary Examiner*—Michael Barr
*Assistant Examiner*—Rita R Patel
(74) *Attorney, Agent, or Firm*—George L. Rideout, Esq.; Armstrong Teasdale LLP

(57) ABSTRACT

A dishwasher rack basket assembly that includes a water impervious basket of open mesh construction, the basket is selectively positionable between a first size and a second size, the first size securing small items while permitting flow of liquid therethrough, the second size smaller than the first size and not securing small items while permitting flow of liquid therethrough, and a projection positioned on the basket, wherein the projection is engageable to transform the basket from the first size to the second size.

22 Claims, 10 Drawing Sheets

DISHWASHER BASKET

BACKGROUND OF THE INVENTION

This invention relates generally to basket assemblies, and, more particularly, to small, item basket assemblies for use in automatic washing machines.

Conventional dishwashing machines include a washing chamber in which upper and lower dishware racks are slidably mounted. Each rack is typically supported on side walls of the dishwasher and includes rollers for sliding movement between an extended position wherein the rack is substantially outside of the washing chamber and a retracted position wherein the rack is substantially inside the washing chamber. As dishware items are loaded and unloaded, the racks are moved to their extended positions for substantially unobstructed loading of items. The racks are lattice structures adapted for holding dishes, plates, cups, pots, pans and other dishware, cookware, and food storage containers while permitting water spray action for cleaning items in the racks. As at least some small items, such as bottle tops, lids, and measuring spoons, are too small for the racks to accommodate, a small item basket containing one or more compartments is typically attached to one of the racks to hold smaller items within the washing chamber.

Typically, users remove the small items basket when not in use and store under the sink or in a drawer. Removing the basket increases usable rack space. However, attaching and detaching the basket may be time consuming and awkward. Eliminating the need to remove the basket while not in use and increasing usable rack space during dishwasher operations are desirable features of a small items basket.

BRIEF DESCRIPTION OF THE INVENTION

In one aspect, a dishwasher rack basket assembly is provided that includes a water impervious basket of open mesh construction, the basket is selectively positionable between a first size and a second size, the first size securing small items while permitting flow of liquid therethrough, the second size smaller than the first size and not securing small items while permitting flow of liquid therethrough, and a projection positioned on the basket, wherein the projection is engageable to transform the basket from the first size to the second size.

In another aspect, a rack assembly for a dishwasher machine is provided that includes a dish rack for retaining items to be washed, a basket assembly removably attached to the rack, wherein the basket includes a plurality of longitudinal walls having a first length, a plurality of lateral walls having a second length, each of the lateral walls is pivotably attached to at least one of the longitudinal walls, a bottom wall pivotably attached to at least one of the longitudinal walls, a lid pivotably attached to at least one of the longitudinal walls, and a knob positioned on at least one of the longitudinal walls.

In another aspect, a dishwasher is provided that includes a cabinet including an interiorly disposed washing chamber, a dish rack disposed in the washing chamber, and at least one basket assembly collapsible between a first size and a second size having a generally rectangular cross section and removably attached to the. The basket assembly includes a pair of spaced apart end walls movably coupled to a pair of spaced apart elongate walls, such that the end walls and the elongate walls are movable between a first position and a second position, the second position collapsing the basket assembly, a bottom wall pivotably coupled to at least one of the elongate walls, such that the bottom wall is rotatable between a first position and a second position, a lid pivotably coupled to at least one of the elongate walls, and a knob positioned on at least one of the elongate walls.

DETAILED DESCRIPTION OF THE INVENTION

Figure 1:
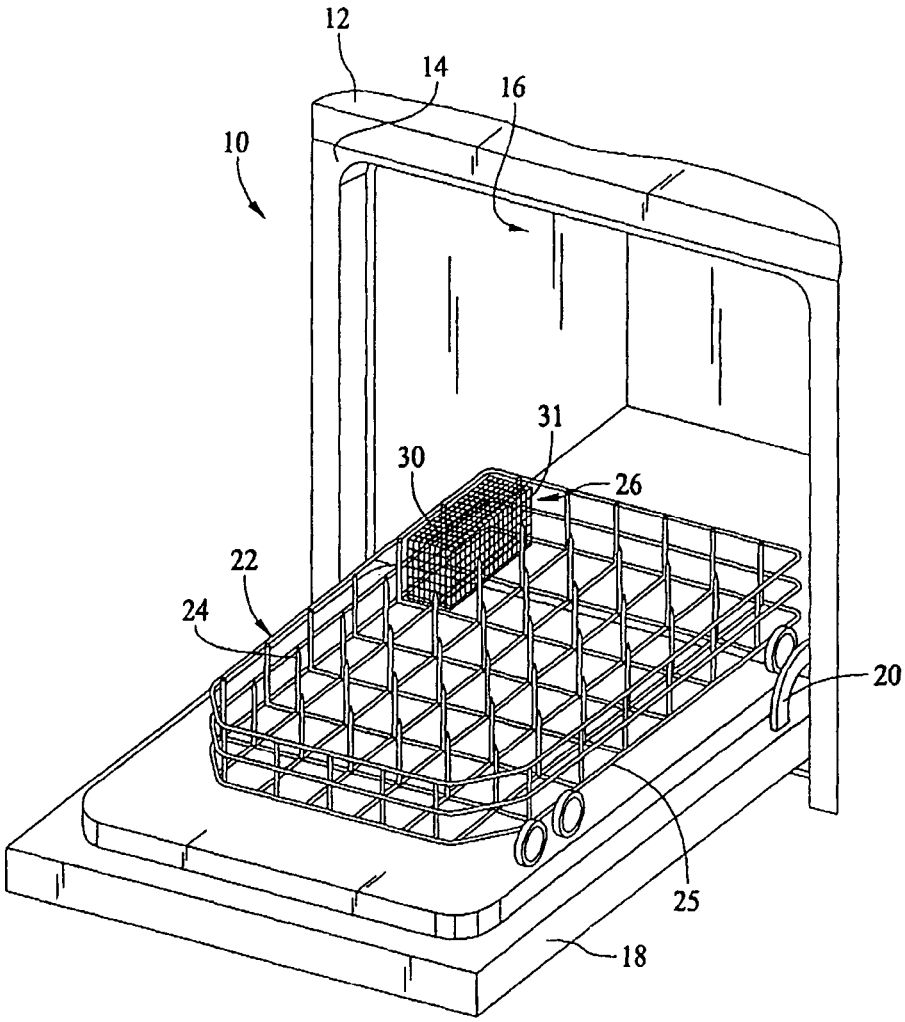
FIG. 1 is a perspective view of a dishwasher including a small items basket with a lid in a closed position.

FIG. 1 is perspective view of an under the counter type automatic domestic dishwasher 10 installed in a typical kitchen cabinet 12. The dishwasher 10 includes a cabinet 14 defining a wash chamber 16. A door 18 is hinged 20 to move between a horizontal position (shown in FIG. 1), providing access to the chamber 16 and a vertical position (not shown). A lower rack 22 is moveable into and out of chamber 16 and supports dishes, glasses, utensils, and other items to be washed, as is well known in the art. Typically dishwashers also include an upper rack (not shown), also moveable into and out of the chamber 16, and various other parts and components, which are well known and have been omitted for the sake of simplicity.

Rack 22 has a reticulated or open network construction so that wash and rinse liquid sprayed into chamber 16 can freely impinge upon items supported on rack 22 and drain back into the bottom of chamber 16. A network of spaced apart, vertical tines or fingers 24 extend upward from a bottom 26 of rack 22 to support dishes, glasses, and other items placed in rack 22. Tines 24 may be omitted from an area of rack 22 to provide an open area 28 to receive a small item basket assembly 30. Basket assembly 30 may be used for placement of tops, lids, measuring spoons, and other dishwasher items that are too small to be accommodated by the open network construction.

Basket assembly 30 includes at least one connector 31 for removably securing at least one wall of basket assembly 30 to rack 22. In one embodiment, connector 31 is a plastic snap ring. It is understood that various types of connectors, fasteners, or clasps may be implemented to attach and detach basket assembly 30 to rack 22.

Figure 2:
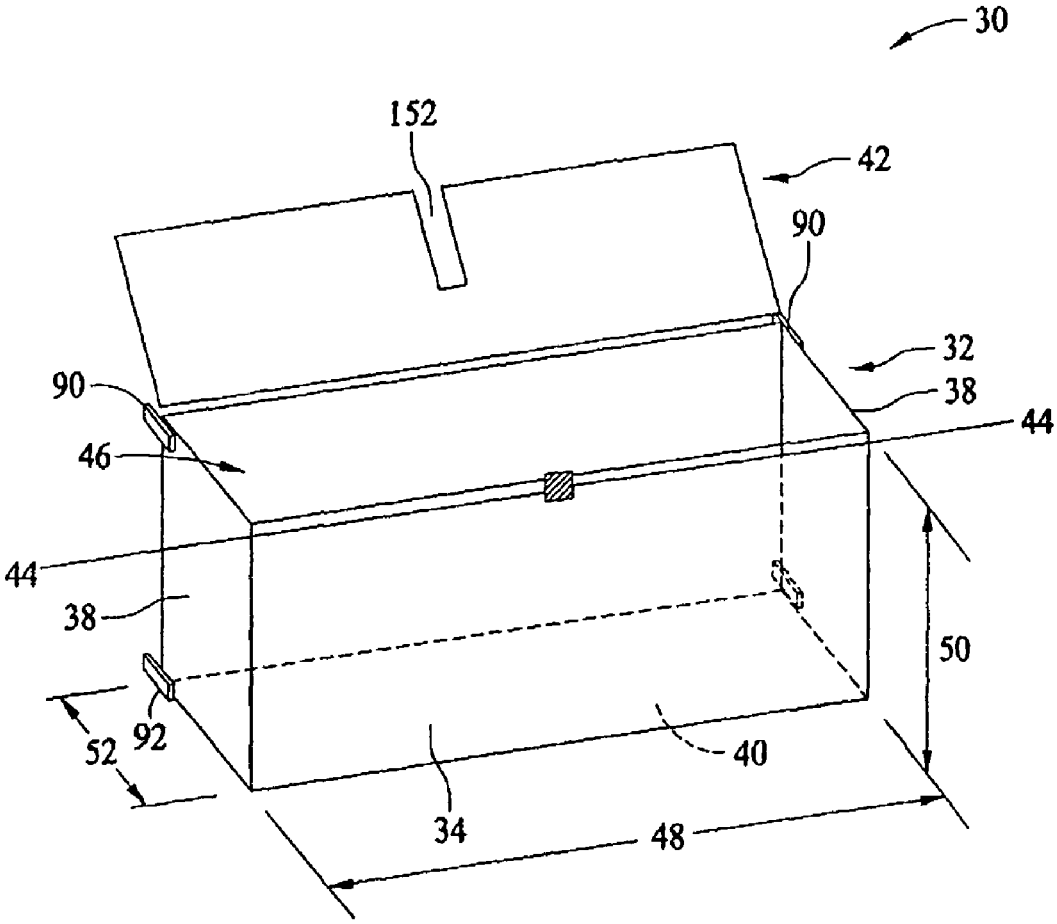
FIG. 2 is a perspective view of the basket in FIG. 1 with the lid open.

FIG. 2 is a perspective view of an exemplary small item basket assembly 30 including a basket 32 that includes a front wall 34, a back wall 36, a pair of opposite side walls 38, a bottom wall 40, and a lid 42. Back wall 36 is substantially parallel to front wall 34 and to a longitudinal axis 44. Bottom wall 40 is substantially parallel to lid 42 and to longitudinal axis 44. Side walls 38 are substantially parallel to one another and substantially perpendicular to front, back, and bottom walls 34, 36, 40 and lid 42. Thus, when basket assembly 32 is in an expanded position as shown in FIG. 1, basket 32 defines a compartment 46. In one embodiment, compartment 46 is rectangular-shaped. In another embodiment, compartment 46 is cubical-shaped.

Front and back walls 34, 36 extend a length 48 and a height 50. Each of side walls 38 extend a length 52 and height 50. Bottom wall 40 and lid 42 extend length 48 and height 50. In one embodiment height 50 is equal to length 52 and length 48 is greater than height 50 and length 52. In an alternative embodiment, height 50 is not equal to length 52 and length 48 is greater than height 50 and length 52. In the illustrated embodiment, length 48 is approximately eight inches, height 50 is approximately five inches, and length 52 is approximately five inches.

Each of walls 34, 36, 38, 40 and lid 42 is fabricated from materials and techniques known in the art to form a lattice structure or framework therein that permits water spray action cleaning of items in basket 32 and to drain out. In one embodiment, each of walls 34, 36, 38, 40 and lid 42 is fabricated from a rigid, but flexible, plastic material, such as polypropylene. In an alternate embodiment, each of walls 34, 36, 38, 40 and lid 42 is fabricated from steel wires which have been welded together and coated with a vinyl or plastic material.

Figure 3:
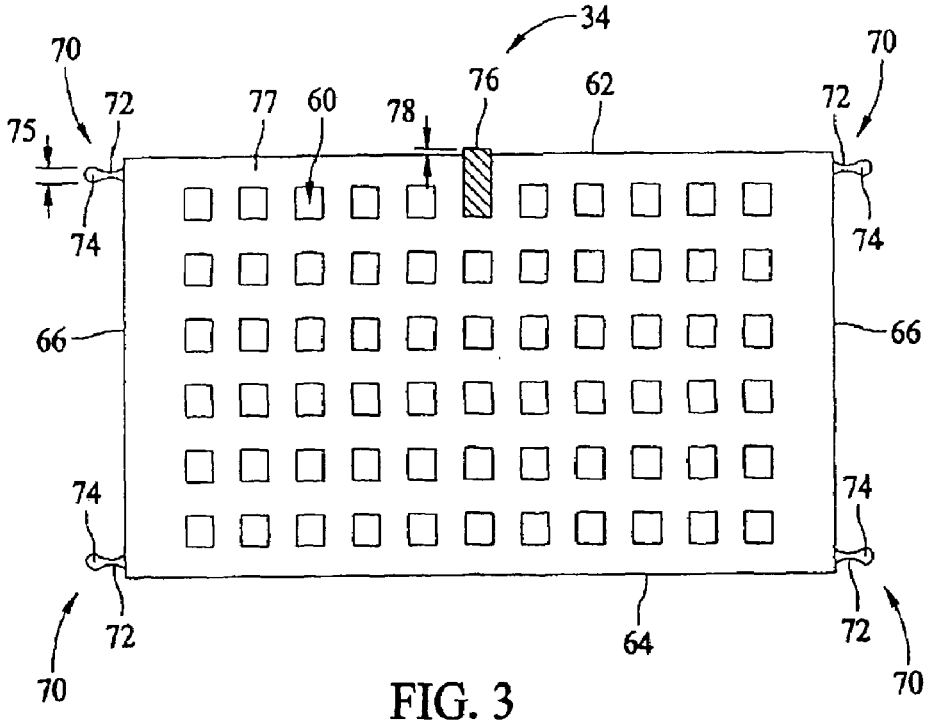
FIG. 3 is a front view of the front wall of the basket in FIG. 2.
Figure 4:
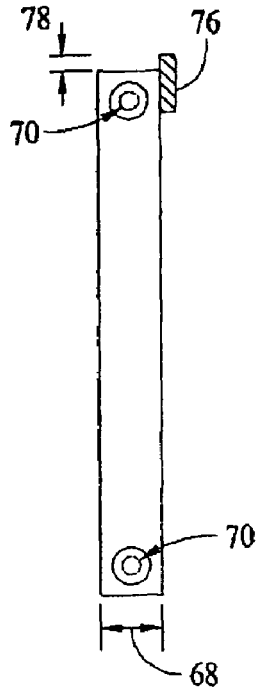
FIG. 4 is a side view of the front wall in FIG. 3.

FIG. 3 is a front view and FIG. 4 is a side view of front wall 34. Front wall 34 is moveable between a forward position (shown in FIG. 2) to a collapsed position 180 (shown in FIG. 15). Front wall 34 is slidable attached to side walls 38 (shown in FIG. 2). Front wall 34 has a lattice structure that includes a plurality of apertures 60 that permit water to pass therethrough.

Front wall 34 includes substantially horizontal upper and lower edges 62, 64, opposite substantially vertical ends or corners 66, and a width 68. In one embodiment, each of ends 66 includes at least two slide portions 70 positioned proximate upper edge 62 and lower edge 64, respectively. In another embodiment, each of ends 66 includes a plurality of slide portions 70 positioned equal distant through out the length of each end 66.

Each of slide portions 70 extends substantially perpendicular to end 66 and include a body 72 and a head 74, each approximately centered thereon and extending outward from slide portion 70. Head 74 has a diameter 75 and is configured to slidably engage a side wall slot 114 (shown in FIG. 7). In one embodiment, head 74 is spherically shaped. In another embodiment, head 74 is cubical-shaped.

Front wall 34 includes a knob 76 positioned on and extending outward from a front wall outer surface 77. Knob 76 is sized such that a user may securely grasp knob 76. In one embodiment, knob 76 is formed integrally with front wall 34. In an alternate embodiment, knob 76 is coupled to front wall 34 using a chemical fastener, including, but not limited to, an adhesive. Knob 76 extends a distance 78 above upper edge 62 is configured to snap fit engage lid slot 152 and secure lid 42 (shown in FIG. 2) adjacent to upper edge 62.

Figure 5:
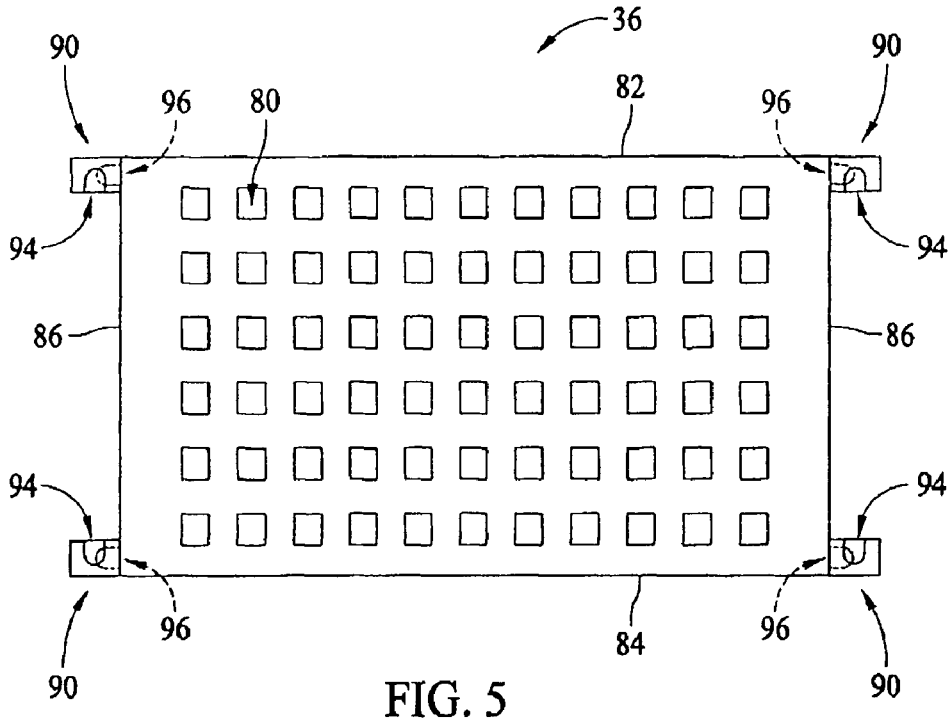
FIG. 5 is a front view of the back wall of the basket in FIG. 2.
Figure 6:
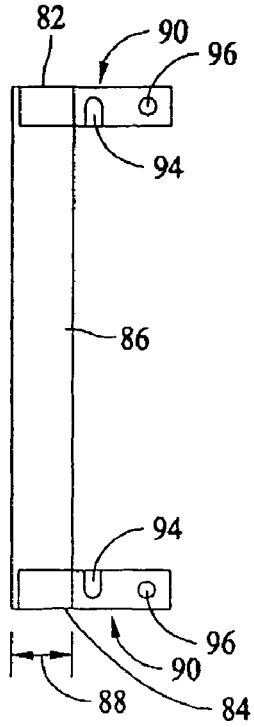
FIG. 6 is a side view of the back wall in FIG. 5.

FIG. 5 is a front view and FIG. 6 is a side view of back wall 36. Back wall 36 is fixed in a vertical position (shown in FIG. 2) when basket 32 is in an expanded position 170 (shown in FIG. 13) or in collapsed position 180 (shown in FIG. 15). Back wall 36 has a lattice structure that includes a plurality of apertures 80 that permit water to pass therethrough.

Back wall 36 includes substantially horizontal upper and lower edges 82, 84, opposite substantially vertical ends or corners 86, and a width 88. Back wall 36 includes a plurality of upper and lower hinges 90 positioned adjacent upper edge 82 and lower edge 84, respectively. Hinges 90 are fabricated from the same material as basket 32. In one embodiment, hinges 90 are fabricated from polypropylene. Hinges 90 are sized relative to basket assembly 30. In one embodiment, hinges 90 are integral with back wall 36. In another embodiment, hinges 90 are coupled to back wall 36 using a chemical fastener, including, but not limited to, an adhesive.

Each of hinges 90 is configured to permit rotation of side walls 38 (shown in FIG. 2), bottom wall 40 (shown in FIG. 2), and lid 42 (shown in FIG. 2). Specifically, each of hinges 90 has a receptacle 94 that cooperates with a side wall pivot pin 140 (shown in FIG. 7) and a receptacle 96 that cooperates with a lid pivot pin 160 (shown in FIG. 11) and a bottom wall pivot pin (shown in FIG. 9).

Figure 7:
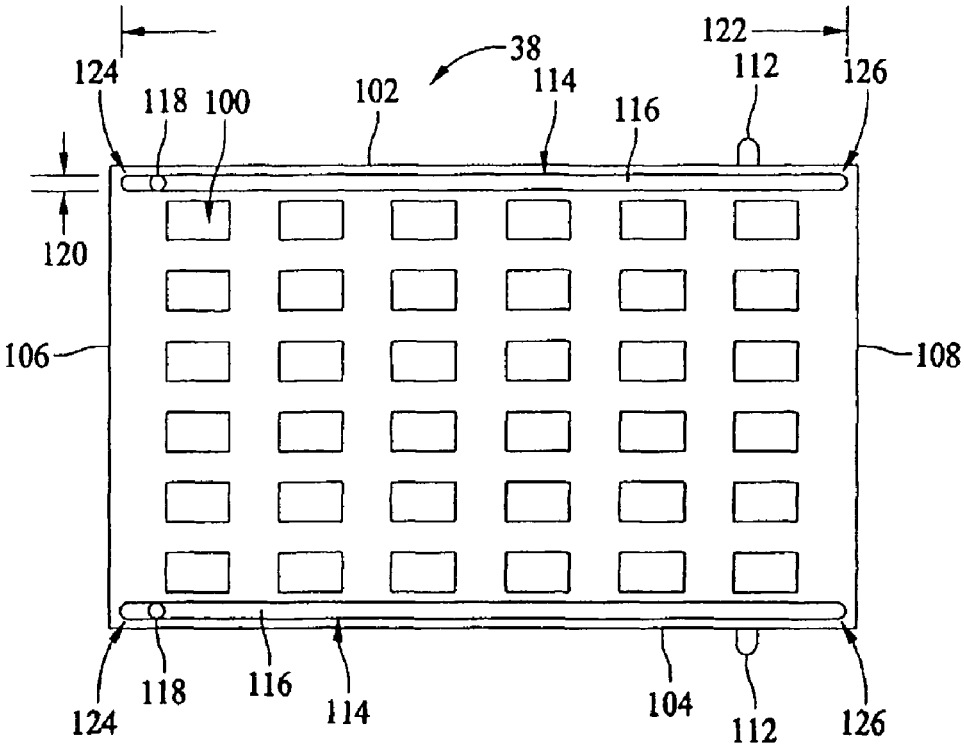
FIG. 7 is a front view of a side wall of the basket in FIG. 2.
Figure 8:
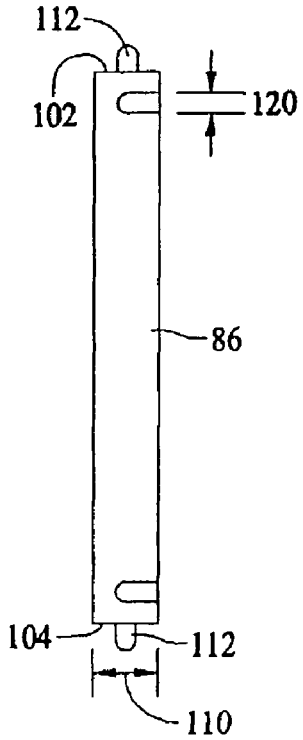
FIG. 8 is a side view of the side wall in FIG. 7.

FIG. 7 is a front view and FIG. 8 is a side view of side wall 38. Side wall 38 is moveable between a side position (shown in FIG. 2) to a collapsed position 180 (shown in FIG. 15). Each of side walls 38 is slidable attached to front walls 34 (shown in FIG. 2) and rotably attached to back wall 36 (shown in FIG. 2). Side walls 38 have a lattice structure that includes a plurality of apertures 100 that permit water to pass therethrough.

Each of side walls 38 includes substantially horizontal upper and lower edges 102, 104, a substantially vertical front end 106, a substantially vertical back end 108, and a width 110. A plurality of pivot pins 112 extend perpendicularly from each of upper edge 102 and lower edge 104, respectively, and are positioned proximate back end 108. Pins 112 are sized and configured to engage and cooperate with back wall hinges 90 (shown in FIG. 5) such that side walls 38 are rotable.

Each of side walls 38 includes at least two slots 114 that extend between front end 106 and back end 108 and parallel along each of upper edge 102 and lower edge 104, respectively. In another embodiment, each of side walls 38 includes a plurality of slots 114 positioned in a plurality of rows that extend parallel between front end 106 and back end 108.

Each of slots 114 extends substantially the length of edges 102, 104 and includes an opening 116 and a projection 118 disposed therein. Opening 116 includes a diameter 120 that extends throughout a length 122 of each slot 114 and is configured to receive front wall head 74 (shown in FIG. 3). In one embodiment, opening 116 is sized such that head 74 has a snap-fit engagement. In another embodiment, opening 116 is sized such that head diameter 75 (shown in FIG. 3) is approximately equal to slot diameter 120.

Additionally, each of slots 114 includes a front slot end 124 and a back slot end 126 disposed therein. Each projection 118 is positioned proximate front slot end 124 and sized to permit each front wall head 74 to frictionally pass over each projection 118 such that front wall 34 (shown in FIG. 3) is adjacent side wall front end 106 when front wall 34 is in the front position (shown in FIG. 2). Slots 114 are configured to permit front wall 34 to slide from front slot end 124 to back slot end 126.

Figure 9:
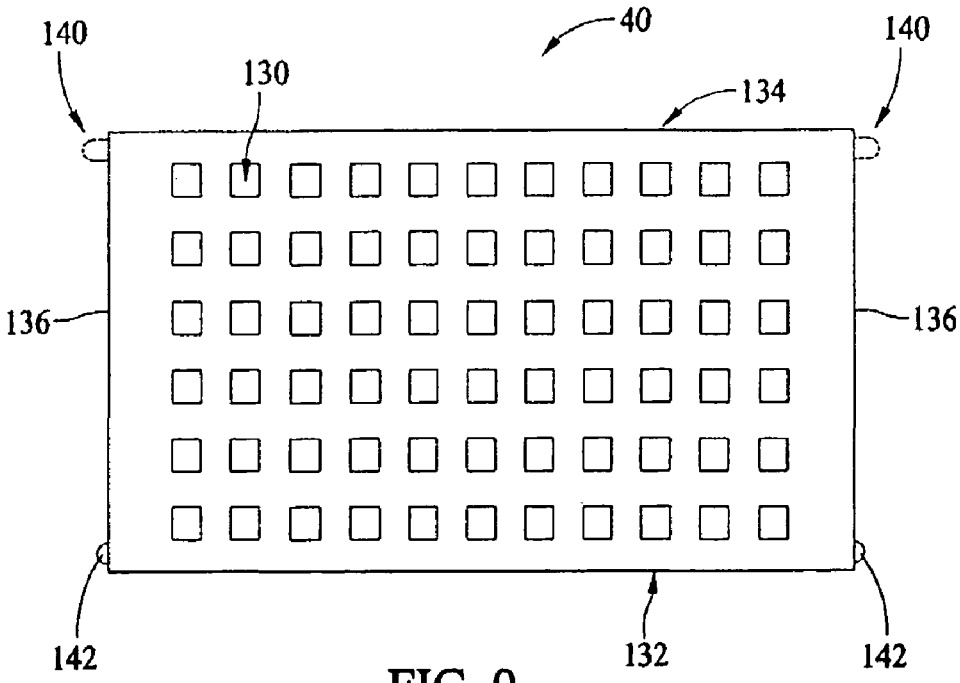
FIG. 9 is a top view of the bottom wall of the basket in FIG. 2.
Figure 10:
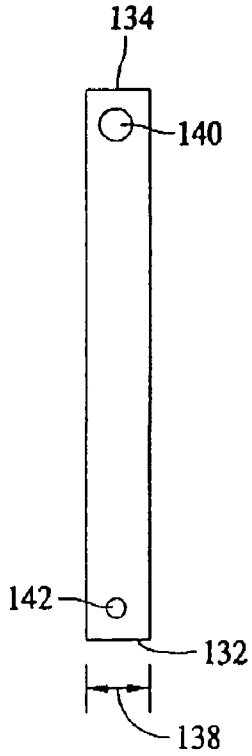
FIG. 10 is a side view of the bottom wall in FIG. 9.

FIG. 9 is a top view and FIG. 10 is a side view of bottom wall 40. Bottom wall 40 is moveable between a horizontal position (shown in FIG. 2) to a vertical position (shown in FIG. 13). Bottom wall 40 is snap-fit attached to side walls 38 (shown in FIG. 2) and rotatably attached to back wall 36 (shown in FIG. 2). Bottom wall 40 has a lattice structure that includes a plurality of apertures 130 that permit water to pass therethrough.

Bottom wall 40 includes substantially horizontal front and back ends 132, 134, opposite substantially horizontal side ends 136, and a width 138. A plurality of pivot pins 140 extend perpendicular from each of ends 136 and are positioned proximate back end 134. Pins 140 are sized and configured to engage and cooperate with back wall hinges 90 (shown in FIG. 5) such that bottom wall 40 is rotatable upward towards back wall 36.

A plurality of projections 142 extend perpendicular from each of ends 136 and are positioned proximate front end 132. Projections 142 are sized and configured to engage and cooperate with side wall slots 114 (shown in FIG. 7) such that bottom wall 40 is fixed in a horizontal position when basket 32 is in expanded position 170 (shown in FIG. 13). Projections 142 permit bottom wall 40 to rotate upward towards back wall 36 in a vertical position when basket 32 is in collapsed position 180 (shown in FIG. 15).

Figure 11:
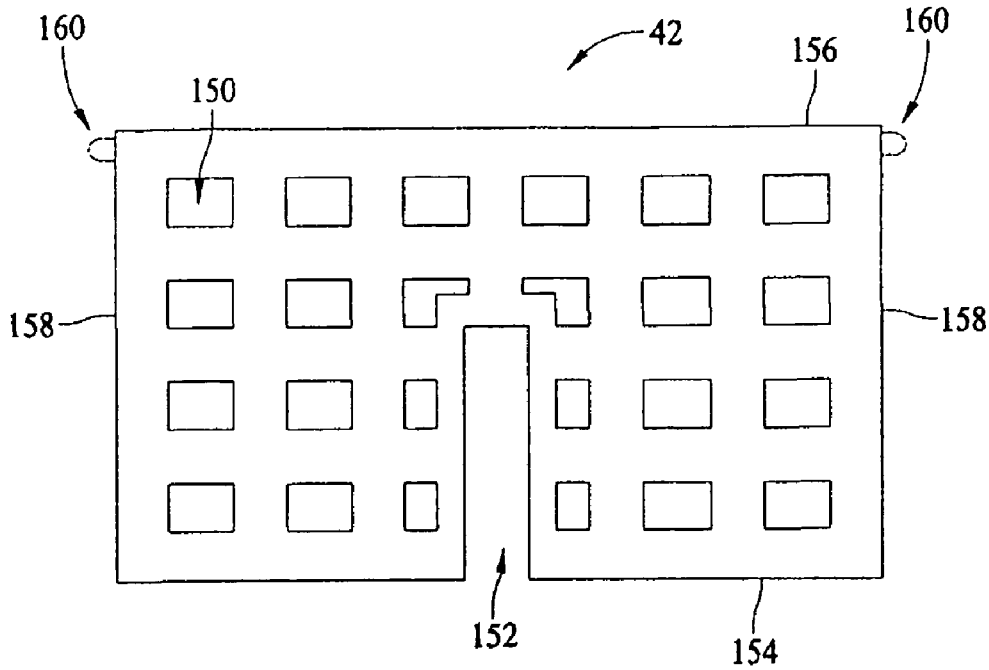
FIG. 11 is a top view of the lid of the basket in FIG. 2.
Figure 12:
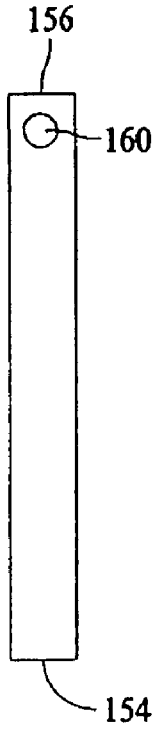
FIG. 12 is a side view of the lid in FIG. 11.

FIG. 11 is a top view and FIG. 12 is a side view of lid 42. A lid 42 is moveable between a horizontal open position (shown in FIG. 2), so as to provide access to basket 32 (shown in FIG. 2) and so small and light weight items can be secured within basket 32, and a vertical closed position (not shown in FIG. 1) overlying basket 32 so that the small and light weight items will not be blown or ejected out of basket 32 by the force of the water during the wash and rinse cycles of dishwasher 10 (shown in FIG. 1). Lid 42 is rotatably attached to back wall 38 (shown in FIG. 2) and snap-fit attached to front wall 34 (shown in FIG. 2). Lid 42 has a lattice structure that includes a plurality of apertures 150 that permit water to pass therethrough and a slot 152 for snap-fit attachment to front wall knob 76.

Lid 42 includes substantially horizontal front and back ends 154, 156 and opposite substantially horizontal side ends 158. A plurality of pivot pins 160 extend perpendicular from each of ends 158 and are positioned proximate back end 156. Pins 160 are sized and configured to engage and cooperate with back wall hinges 90 (shown in FIG. 5) such that lid 42 is rotatable upward.

Figure 13:
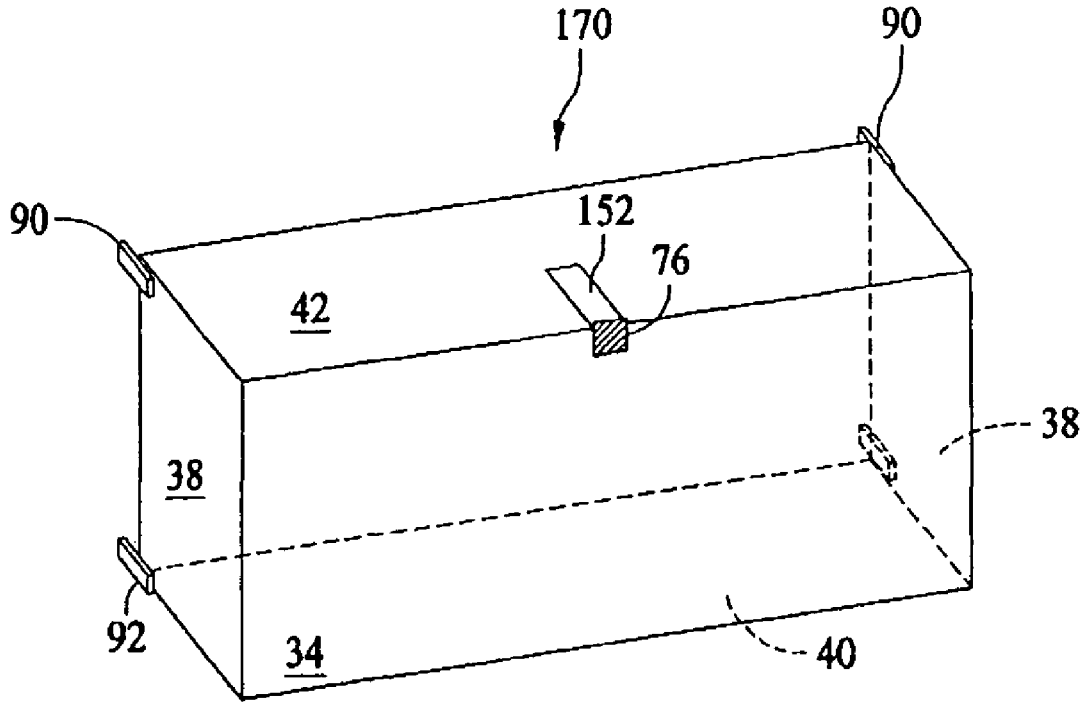
FIG. 13 is perspective view of the basket in FIG. 2 in an expanded position.
Figure 14:
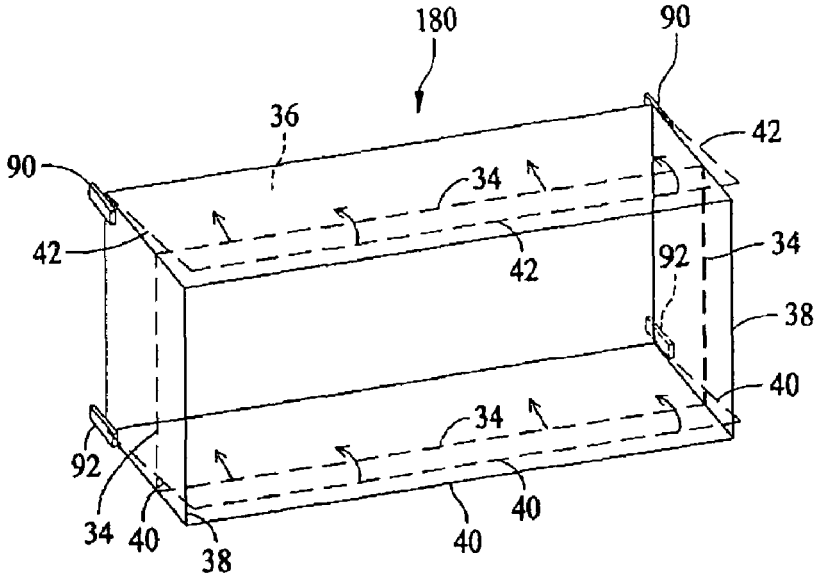
FIG. 14 is a perspective view of the basket in FIG. 13 in transition to a collapsed position.
Figure 15:
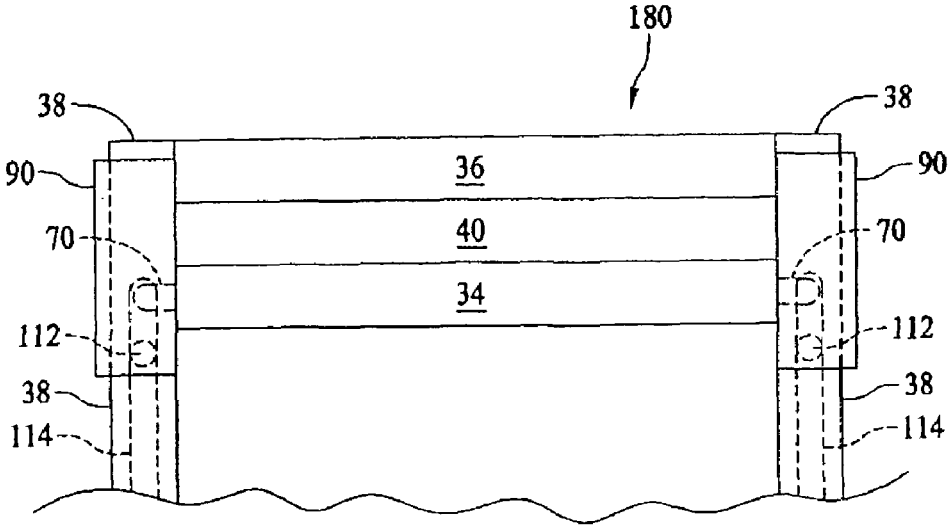
FIG. 15 is a partial top view of the basket in FIG. 13 in transition to a collapsed position.
Figure 16:
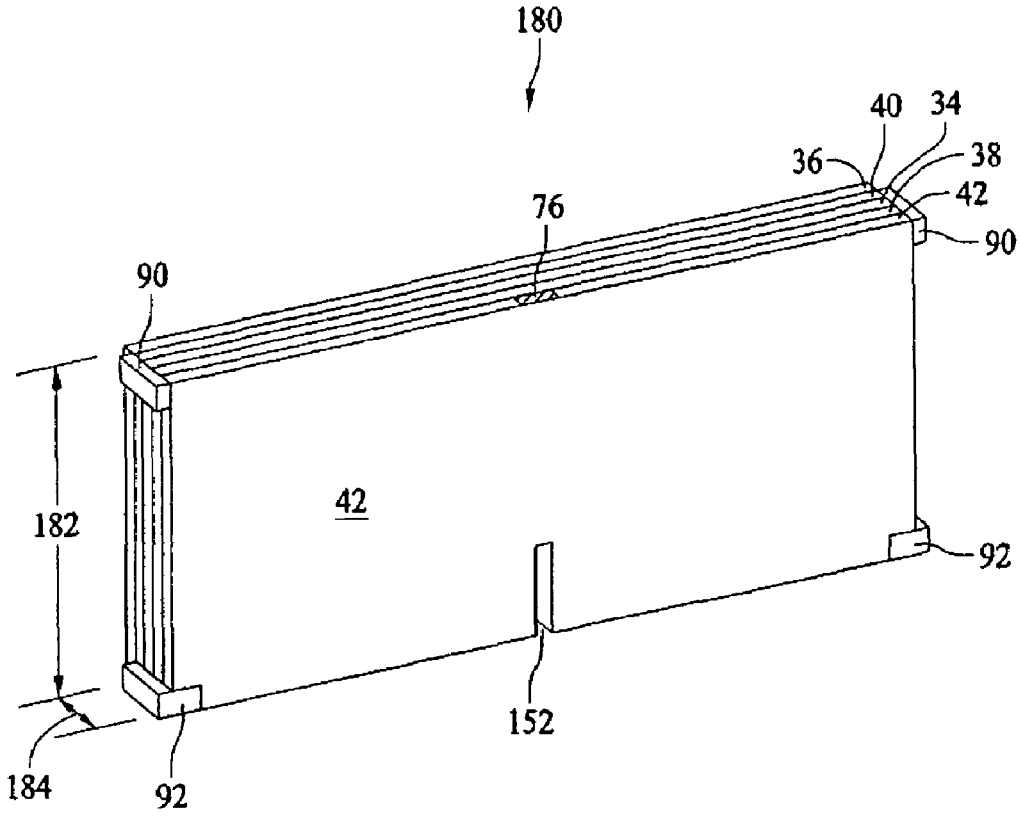
FIG. 16 is a perspective view of the basket in FIG. 13 in the collapsed position.

FIG. 13 is perspective view of basket 32 in expanded position 170. FIG. 14 is a perspective view and FIG. 15 is a partial top view of basket 32 in transition to collapsed position 180. FIG. 16 is a perspective view of basket 32 in collapsed position 180. User can selectively position basket 32 between expanded position 170 and collapsed position 180 in order to increase usable space on rack 22 (shown in FIG. 1).

To collapse basket 32 from expanded position 170, user may grasp front wall knob 76 and push front wall 34 horizontally towards back wall 36. Simultaneously, as front wall slides 70 pass over side wall projections 118, bottom wall projections 142 disengage from side wall slot 114 and bottom wall front end 132 rotates upward and back towards back wall 36 about bottom wall pins 140.

Front wall 34 remains vertical and continues to slide horizontally within side wall slots 114 and forces bottom wall 40 into a vertical position adjacent to back wall 36. Front wall 34 remains adjacent to bottom wall 40, both in a vertical position and adjacent back wall 36. Simultaneously, as front wall 34 slides toward back wall 36 and bottom wall 40 rotates toward back wall 36, side walls 38 rotate on sidewall pivot pins 112 toward back wall 36. Side walls 38 rotate such that each of side wall front ends 106 are adjacent each other adjacent front wall 34. After side walls 38 rotate inward, lid 42 rotates downward about lid pivot pins 160 such that lid 42 is adjacent side walls 38. In the collapsed position, basket assembly 30 has a height 182 and a width 184. In one embodiment, height 182 is approximately 5 inches and width 184 is 0.5 inches.

To expand basket assembly from collapsed position 180, user lifts lid 42 upward about pivot pins 160, rotates side walls 38 outward about pivot pins 112, slides front wall 34 within slots 114 until bottom wall 40 rotates downward about pivot pins 140. Bottom wall projections 142 are snapped into slots 114, front wall 34 is pulled past side wall projections 118 until front wall 34 is adjacent side walls front ends 106.

The above-described small items basket is cost effective and versatile. The small items basket includes a plurality of rotatable and slidable walls such that the small items basket is collapsible, thus eliminating the need to remove the basket while not in use and increasing usable space during dishwasher operations. As a result of the collapsible nature of the basket, the user does not waste time searching for a basket. As a result of the increased usable capacity, the operator may add additional wash items to the dishwasher. Thus a basket is provided which reduces wasted time and conserves energy.

Exemplary embodiments of dishwasher racks and basket assemblies are described above in detail. The racks and baskets are not limited to the specific embodiments described herein, but rather, components of each may be utilized independently and separately from other components described herein. Each racks and basket component can also be used in combination with other dishwasher components.

While the invention has been described in terms of various specific embodiments, those skilled in the art will recognize that the invention can be practiced with modification within the spirit and scope of the claims.

What is claimed is:

1. A dishwasher rack basket assembly, said basket assembly comprising:

a collapsible basket of open mesh construction comprising a plurality of walls, said plurality of walls comprising:

a back wall, a bottom wall rotatably coupled to said back wall, a front wall including at least one projecting slide portion, said front wall substantially parallel with said back wall and a longitudinal axis of said collapsible basket, and a plurality of side walls connecting said back wall to said front wall, each of said side walls including a front wall end, a back wall end opposite said front wall end, and defining at least one slot extending between said front wall end and said back wall end, said at least one projecting slide portion slidably positioned within a corresponding slot of said at least one slot, said at least one projecting slide portion moveable within said corresponding slot such that said front wall moves with respect to said back wall along a transverse axis substantially perpendicular to said longitudinal axis to position and transform said basket between a first size and a second size, said first size securing small items while permitting flow of liquid therethrough, said second size smaller than said first size and not securing small items while permitting flow of liquid therethrough.

2. A dishwasher rack basket assembly in accordance with claim 1 wherein said basket further comprises a lid pivotally mounted to at least one of said walls.

3. A dishwasher rack basket assembly in accordance with claim 2 wherein said first size is configured such that said bottom wall is oriented substantially horizontally and includes horizontal disposed edges and ends and each of said walls is oriented substantially vertically and includes substantially horizontally disposed upper and lower edges and substantially vertically disposed ends.

4. A dishwasher rack basket assembly in accordance with claim 3 wherein said first size is substantially rectangular shaped.

5. A dishwasher rack basket assembly in accordance with claim 2 wherein said bottom wall, each of said walls, and said lid is oriented substantially vertically.

6. A dishwasher rack basket assembly in accordance with claim 1 wherein said bottom wall and each of said walls is integrally molded and formed from polypropylene.

7. A dishwasher rack basket assembly in accordance with claim 1 wherein said basket assembly includes at least one connector for releasably securing said basket assembly to said dishwasher rack.

8. A dishwasher rack basket assembly in accordance with claim 1 wherein said at least one slide portion is mounted to at least one of said walls, said at least one slide portion permits a user to transform said basket assembly from said first size to said second size.

9. A rack assembly for a dishwasher machine, said rack assembly comprising:

a dish rack for retaining items to be washed;

a collapsible basket assembly removably attached to said rack, said basket assembly comprising:

a plurality of longitudinal walls having a first length, said longitudinal walls comprising a back wall and a front wall including at least one projecting slide portion, said front wall substantially parallel to said back wall and to a longitudinal axis of said collapsible basket;

a plurality of lateral walls connecting said back wall to said front wall, each of said lateral walls having a second length and being pivotably attached to at least one of said longitudinal walls, each of said lateral walls comprising:

a front wall end;

a back wall end opposite said front wall end; and at least one slot extending between said front wall end and said back wall end, said at least one projecting slide portion slidably positioned within a corresponding slot of said at least one slot and moveable within said corresponding slot such that said front wall moves with respect to said back wall along a transverse axis substantially perpendicular to said longitudinal axis to position and transform said basket assembly between a first size and a second size;

a bottom wall pivotably attached to at least one of said longitudinal walls;

a lid pivotably attached to at least one of said longitudinal walls; and a knob positioned on at least one of said longitudinal walls.

10. A rack assembly in accordance with claim 9 wherein said second size smaller than said first size.

11. A rack assembly in accordance with claim 10 wherein said basket assembly first size includes said bottom wall extending perpendicular to said lateral walls and said longitudinal walls and forms a generally rectangular cross section.

12. A rack assembly in accordance with claim 10 wherein said basket assembly second size includes said bottom wall extending vertically and parallel to said lateral walls and said longitudinal walls.

13. A rack assembly in accordance with claim 9 wherein said knob is engageable to move said basket assembly between said first size and said second size, said second size collapsing said basket assembly.

14. A rack assembly in accordance with claim 9 wherein said knob is configured to secure said lid adjacent each of said lateral walls.

15. A rack assembly in accordance with claim 9 wherein said bottom wall, each of said lateral walls, each of said longitudinal walls, and said lid is made from polypropylene and is substantially of an open mesh construction to secure small items while permitting flow of liquid through said basket assembly.

16. A rack assembly in accordance with claim 9 wherein said basket assembly includes at least one integral connector for removably securing said basket assembly to said rack assembly.

17. A dishwasher comprising:

a cabinet including an interiorly disposed washing chamber;

a dish rack disposed in said washing chamber; and at least one basket assembly collapsible between a first size and a second size having a generally rectangular cross section and removably attached to said rack, said at least one basket assembly comprising:

a pair of spaced apart elongate walls comprising a back wall and a front wall including at least one projecting slide portion, said front wall substantially parallel to said back wall and to a longitudinal axis of said collapsible basket;

a pair of spaced apart end walls movably coupled to said pair of spaced apart elongate walls to connect said back wall to said front wall, each of said end walls comprising:

a front wall end;

a back wall end opposite said front wall end; and at least one slot extending between said front wall end and said back wall end, said at least one projecting slide portion slidably positioned within a corresponding slot of said at least one slot and moveable within said corresponding slot such that said front wall moves with respect to said back wall along a transverse axis substantially perpendicular to said longitudinal axis to position and transform said basket assembly between said first size and said second size;

a bottom wall pivotably coupled to at least one of said elongate walls, such that said bottom wall is rotatable between a first position and a second position;

a lid pivotably coupled to at least one of said elongate walls; and a knob positioned on at least one of said elongate walls.

18. A dishwasher in accordance with 17 wherein said basket assembly second size is smaller than said basket assembly first size.

19. A dishwasher in accordance with 17 wherein said basket assembly is pervious to water, such that water is permitted to pass therethrough to wash small items disposed in said basket assembly.

20. A dishwasher in accordance with 17 wherein said basket assembly comprises plastic.

21. A dishwasher rack basket assembly in accordance with claim 1 wherein at least one of said plurality of walls defines a plurality of openings extending therethrough.

22. A collapsible dishwasher rack basket comprising:

a back wall;

a bottom wall rotatably coupled to said back wall;

a front wall including at least one projecting slide portion, said front wall substantially parallel with said back wall and a longitudinal axis of said collapsible dishwasher rack basket; and side walls connecting said back wall to said front wall, each of said side walls including a front wall end, a back wall end opposite said front wall end, and defining at least one slot extending between said front wall end and said back wall end, said at least one projecting slide portion slidably positioned within a corresponding slot of said at least one slot, said at least one projecting slide portion moveable within said corresponding slot such that said front wall moves with respect to said back wall along a transverse axis substantially perpendicular to said longitudinal axis to position and transform said basket between a first configuration and a second configuration securing small items while permitting flow of liquid therethrough, at least one of said back wall, said bottom wall, said front wall and said side walls defining a plurality of openings extending therethrough.

* * * * *